US005216334A

United States Patent [19]

Bach

[11] Patent Number: 5,216,334

[45] Date of Patent: Jun. 1, 1993

[54] DISPLAY BIAS ARRANGEMENT

[75] Inventor: Christopher R. Bach, Elgin, Ill.

[73] Assignee: Motorola, Inc., Schaumburg, Ill.

[21] Appl. No.: 657,902

[22] Filed: Feb. 20, 1991

[51] Int. Cl.[5] ..... H05B 37/00

[52] U.S. Cl. ..... 315/325; 315/96; 315/99; 315/185 R

[58] Field of Search ..... 315/252, 325, 96, 99, 315/185 R

[56] References Cited

U.S. PATENT DOCUMENTS

| | | | |
|---|---|---|---|
| 1,801,022 | 4/1931 | Poncel | 315/96 |
| 1,807,343 | 5/1931 | Poncel | 315/96 |
| 2,043,676 | 6/1936 | Raskhodoff | 315/96 |
| 2,535,147 | 12/1950 | Markusen | 315/252 |
| 2,539,127 | 1/1951 | Glass | 315/252 |
| 4,859,912 | 8/1989 | Lippman | 315/169.1 |

*Primary Examiner*—Robert J. Pascal
*Assistant Examiner*—R. A. Ratliff
*Attorney, Agent, or Firm*—Wayne J. Egan

[57] ABSTRACT

An improved display bias arrangement is provided using a DC filament voltage in conjunction with stepped grid voltages to maintain even illumination. In a VF display there is a directly heated cathode (filament), an anode and a grid. If a DC filament voltage is used, one end of the cathode will be at different potential than the other, thus resulting in a variation in anode-to-cathode potential across the display. This varying potential causes electrons to hit the anode with varying speed, causing a variation in display intensity. In this invention, the cathode (filament) is supplied with a DC voltage and the grid of each segment is supplied with a different voltage, thereby equalizing the anode-to-cathode potential for each display digit. In a first embodiment, resistor networks are used to equalize the anode-to-cathode voltages. In a second embodiment, diode networks are used to equalize the anode-to-cathode voltages.

7 Claims, 2 Drawing Sheets

— PRIOR ART —

— PRIOR ART —

DISPLAY BIAS ARRANGEMENT

TECHNICAL FIELD

This application relates to vacuum fluorescent (VF) display arrangements.

BACKGROUND OF THE INVENTION

Vacuum fluorescent (hereinafter "VF") display arrangements are known. All present filament bias methods for large VF displays appear to use a center-tapped transformer as the bias source. The transformer is either run from the alternating current (hereinafter "AC") power mains or as part of a direct current (hereinafter "DC")-to-DC converter. Requiring the storage element in a DC-to-DC converter to have a floating center tapped output greatly increases the cost of the energy storage element, typically about $1.50. A DC-to-DC converter for the anodes and grids of a VF display only has to supply about 20 milli Ampere (hereinafter "mA") and the required inductor may cost less than $0.10.

A prior art DC arrangement 100 is shown in FIG. 1. There is shown a display arrangement comprising a first display digit 101, a second display digit 111, and a third display digit 121. The display digit 101 includes an anode 102, a grid 103, a cathode 104, and a grid terminal 107. The display digit 111 includes an anode 112, a grid 113, a cathode 114, and a grid terminal 117. The display digit 121 includes an anode 122, a grid 123, a cathode 124, and a grid terminal 127. Note the anodes 102, 112, and 122 are connected to +30 volts. Note the cathodes 104, 114 and 124 are connected in series. Thus, the potential at cathode 104 will be near +5 volts, the potential at cathode 114 will be near +2.5 volts, and the potential at cathode 124 will be near ground. Assuming that a voltage pulse of +30 volts is applied to each of the three individual grid terminals 107, 117, and 127, this would result in varying grid (103, 113, 123)-to-cathode (104, 114, 124) potentials, as shown in FIG. 2.

Referring now to FIG. 2, there are shown three (3) typical signal waveforms 201, 211, and 221 of pulses appearing at the grids 103, 113, and 123, respectively, of the arrangement 100 of FIG. 1. Each waveform (201, 211, 221) represents the voltage measured from the grid (103, 113, 123) with respect to the cathode (104, 114, 124) of the respective display device (101, 111, 121). Thus, waveform 201 represents the voltage at grid 103 (and terminal 107) measured with respect to cathode 104; waveform 211 represents the voltage at grid 113 (and terminal 117) measured with respect to cathode 114; and, waveform 221 represents the voltage at grid 123 (and terminal 127) measured with respect to cathode 124. The waveform pulses 201, 211, and 221 have associated magnitudes 202, 212, and 222, respectively. It will be recalled that, since cathodes 104, 114, and 124 are connected in series, then the voltage (with respect to ground) at the cathodes 104, 114, and 124 will vary. As a result, since the potential at the display device grids 103, 113, and 123 is a uniform +30 volts, then the respective grid-to-cathode voltages will also vary. Thus, since $V_{104}>V_{114}>V_{124}$, this results in the relationship $V_{202}<V_{212}<V_{222}$. The display intensity (or illuminating energy) of any device, of course, is directly related to the magnitude of the grid-to-cathode potential. Since the grid-to-cathode potentials of devices 103, 113, and 123 vary, then this, of course, results in the display luminescence energy in devices 103, 113, and 123 varying. This is because the varying potential causes electrons to hit the anode with varying speed causing a variation in display intensity.

As a result, there is a need for an improved display bias arrangement.

SUMMARY OF THE INVENTION

It is an object of the invention to provide an improved display bias arrangement. This invention uses a DC filament voltage in conjunction with stepped grid voltages to maitain even illumination. In a VF display there is a directly heated cathode (filament), an anode and multiple grids. If a DC filament voltage is used, one end of the cathode will be at different potential than the other, thus resulting in a variation in anode-to-cathode potential across the display. This varying potential causes electrons to hit the anode with varying speed, causing a variation in display intensity.

In this invention, the cathode (filament) is supplied with a DC voltage and the grid of each digit is supplied with a different voltage, thereby equalizing the anode-to-cathode potential for each display digit. In a first embodiment, resistor networks are used to equalize the anode-to-cathode voltages. In a second embodiment, diode networks are used to equalize the anode-to-cathode voltages.

DETAILED DESCRIPTION OF THE INVENTION

Figure 1:
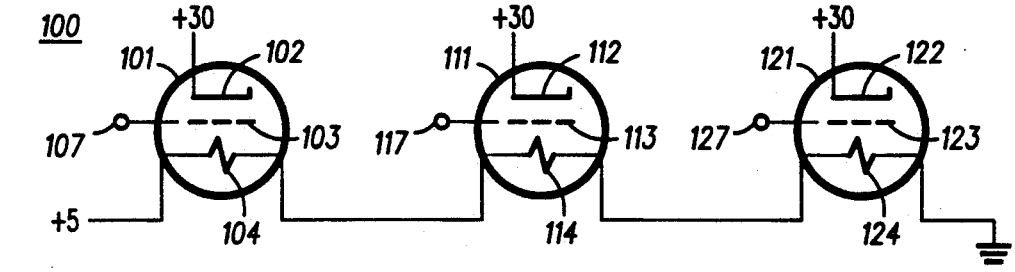
FIG. 1 depicts a prior art display arrangement 100.
Figure 2:
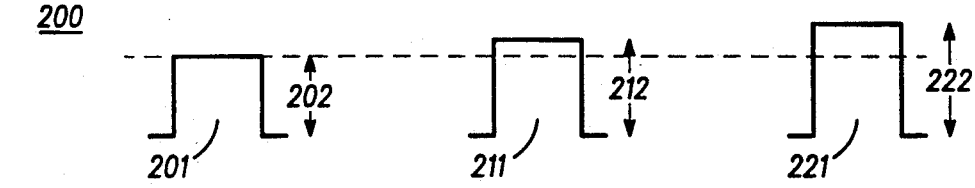
FIG. 2 depicts waveforms for the display arrangement 100 of FIG. 1.
Figure 3:
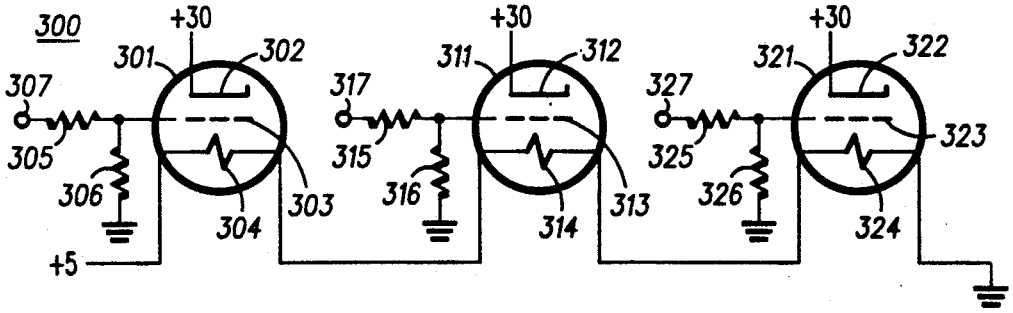
FIG. 3 depicts a first embodiment of a display bias arrangement, according to the invention.

FIG. 3 depicts a first embodiment of a display bias arrangement 300, according to the invention. There is shown a display arrangement comprising a first display digit 301, a second display digit 311, and a third display digit 321. The display digit 301 includes an anode 302, a grid 303, a cathode 304, and a grid terminal 307. The display digit 311 includes an anode 312, a grid 313, a cathode 314, and a grid terminal 317. The display digit 321 includes an anode 322, a grid 323, a cathode 324, and a grid terminal 327. Note the anodes 302, 312, and 322 are connected to +30 volts. Note the cathodes 304, 314 and 324 are connected in series. Thus, the potential at cathode 304 will be near +5 volts, the potential at cathode 314 will be near +2.5 volts, and the potential at cathode 324 will be near ground.

In the arrangement 300 (as in the prior art arrangement 100), it is assumed that +30 volts is applied to grid terminals 307, 317, and 327. Since the potentials at the cathodes 304, 314, and 325 vary, this means the potentials at grid terminals 307, 317, and 327 with respect to cathodes 304, 314, and 324 will vary. The goal, of course, is to equalize the potentials at grids 303, 313, and 323 with respect to cathodes respective 304, 314, and 324. For this reason, a first network comprising resistors 305, 306 is connected in series with grid 303 and terminal 307; a second network comprising resistors 315, 316 is connected in series with grid 313 and terminal 317; and a third network comprising resistors 325, 326 is connected in series with grid 323 and terminal 327. The values of resistors 305, 306, 315, 316, 325, and 326 are selected so that the potentials at grids 303, 313, and 323 with respect to respective cathodes 304, 314, and 324 are equalized.

Figure 4:
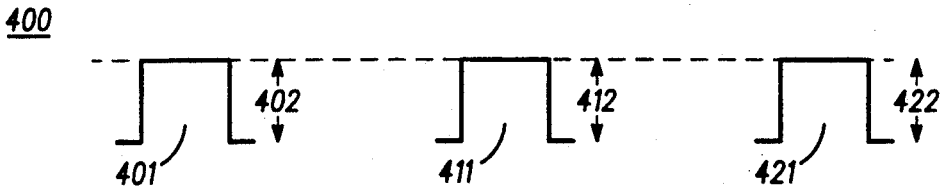
FIG. 4 is a waveform for the first embodiment.

Referring now to FIG. 4, there are shown three (3) typical signal waveforms 401, 411, and 421 of pulses appearing at the grids 303, 313, and 323, respectively, of the arrangement 300 of FIG. 3. Each waveform represents the voltage measured from the grid with respect to the cathode of the respective display device. Thus, waveform 401 represents the voltage at grid 303 measured with respect to cathode 304; waveform 411 represents the voltage at grid 313 measured with respect to cathode 314; and, waveform 421 represents the voltage at grid 323 measured with respect to cathode 324. The waveform pulses 401, 411, and 421 have associated magnitudes 402, 412, and 422, respectively. It will be recalled that, since the values of resistors 305, 306, 315, 316, 325, and 326 have been selected so that the potentials at grids 303, 313, and 323 with respect to respective cathodes 304, 314, and 324 are equalized, then note that $V_{402}=V_{412}=V_{422}$. As before, the display intensity (or illuminating energy) of any device is directly related to the magnitude of the grid-to-cathode potential. Since the grid (303, 313, 323)-to-cathode (304, 314, 324) potentials of devices 301, 311, and 321 are equivalent, then this, of course, results in the display luminescence energy levels in devices 301, 311, and 321 also being equivalent.

Figure 5:
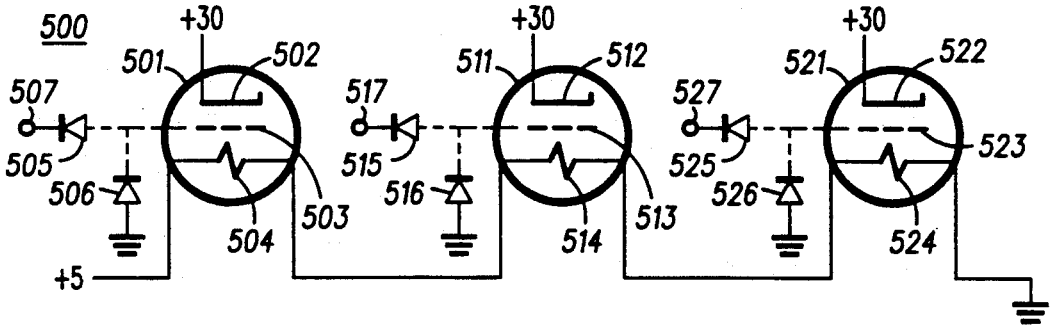
FIG. 5 depicts a second embodiment of a display bias arrangement, according to the invention.

FIG. 5 depicts a second embodiment of a display bias arrangement 500, according to the invention. There is shown a display arrangement comprising a first display digit 501, a second display digit 511, and a third display digit 521. The display digit 501 includes an anode 502, a grid 503, a cathode 504, and a grid terminal 507. The display digit 511 includes an anode 512, a grid 513, a cathode 514, and a grid terminal 517. The display digit 521 includes an anode 522, a grid 523, a cathode 524, and a grid terminal 527. Note the anodes 502, 512, and 522 are connected to +30 volts. Note the cathodes 504, 514 and 524 are connected in series. Thus, the potential at cathode 504 will be near +5 volts, the potential at cathode 514 will be near +2.5 volts, and the potential at cathode 524 will be near ground.

In the arrangement 500 (as in the prior art arrangement 100), it is assumed that +30 volts is applied to grid terminals 507, 517, and 527. Since the potentials at the cathodes 504, 514, and 525 vary, this means the potentials at grid terminals 507, 517, and 527 with respect to cathodes 504, 514, and 524 will vary. The goal, of course, is to equalize the potentials at grids 503, 513, and 523 with respect to cathodes respective 504, 514, and 524. For this reason, a first network comprising diode 505 is connected in series with grid 503 and terminal 507 or a first network comprising diode 506 connected in shunt with grid 503 and ground or a first network comprising diode 505 connected in series with grid 503 and diode 506 connected in shunt with grid 503 and ground; a second network comprising diode 515 is connected in series with grid 513 and terminal 517 or a second network comprising diode 516 connected in shunt with grid 513 and ground or a second network comprising diode 515 connected in series with grid 513 and diode 516 connected in shunt with grid 503 and ground; and a third network comprising diode 525 is connected in series with grid 523 and terminal 527 or a third network comprising diode 526 connected in shunt with grid 523 and ground or a third network comprising diode 525 connected in series with grid 523 and diode 526 connected in shunt with grid 523 and ground. The diodes 505 and 506 are connected in a break-down or reverse-bias-configuration in order to precisely regulate the voltage delivered to the grid 503. Likewise, the diodes 515 and 506 are connected in a break-down or back-bias-mode to precisely regulate the voltage delivered to the grid 513. The diodes 525 and 526 are similarly connected to precisely control the voltage delivered to the grid 523. The diodes 505, 506, 515, 516, 525, 526 may be, for instance, Zener diodes. The breakdown voltage values of diodes 505, 506, 515, 516, 517 and 526 are selected so that the potentials at grids 503, 513, and 523 with respect to respective cathodes 504, 514, and 524 are equalized.

Referring still to FIG. 5, one skilled in the art will appreciate, therefore, that there are at least three ways (or options) to use diodes to equalize the grid potential in the respective display digits, as follows: First, a single diode may be connected in series with the grid. Second, a single diode may be connected in parallel with the grid to ground. Third, two diodes may be used-a first in series with the grid, and a second in parallel with the grid to ground.

Referring still to FIG. 5, and more particularly referring to a single digit such as, for example, digit 501 (or 511, or 521), an example of the first way or option (single diode in series with grid) would be connecting diode 505 (or 515, or 525) in series with terminal 507 (or 517, or 527) and grid 503 (or 513, or 523). In the alternative, an example of the second way or option (single diode connected in parallel with grid to ground) would be connecting diode 506 (or 516, or 526) in parallel with grid 503 (or 513, or 523) to ground. In the alternative, an example of the third way or option (two diodes, a first in series with grid, and a second in parallel with grid to ground) would be connecting diode 505 (or 515, or 525) in series with terminal 507 (or 517, or 527) and grid 503 (or 513, or 523) and also connecting diode 506 (or 516, or 526) in parallel with grid 503 (or 513, or 523) to ground.

Referring still to FIG. 5, it will be appreciated that all three options, as described above, are depicted by means of dotted lines. Thus, referring only to digit 501, in the case of the first option (single diode in series with the grid), then only diode 505 would exist, and diode 506 would be absent. Likewise, in the case of the second option (single diode in parallel with grid to ground), then only diode 506 would exist, and diode 505 would be missing (replaced by short circuit). Likewise, in the case of the third option (first diode in series with grid, and second diode in parallel with grid to ground), then both diode 505 and diode 506 would exist.

Figure 6:
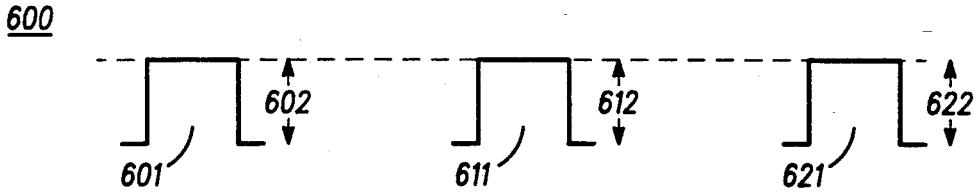
FIG. 6 is a waveform for the second embodiment.

Referring now to FIG. 6, there are shown three (3) typical signal waveforms 601, 611, and 621 of pulses appearing at the grids 503, 513, and 523, respectively, of the arrangement 500 of FIG. 5. Each waveform represents.the voltage measured from the grid with respect to the cathode of the respective display device. Thus, waveform 601 represents the voltage at grid 503 measured with respect to cathode 504; waveform 611 represents the voltage at grid 513 measured with respect to cathode 514; and, waveform 621 represents the voltage at grid 523 measured with respect to cathode 524. The waveform pulses 601, 611, and 621 have associated magnitudes 602, 612, and 622, respectively. It will be recalled that, since the regulating voltage values of diodes 505, 506, 515, 516, 525, and 526 have been selected so that the potentials at grids 503, 513, and 523 with respect to respective cathodes 504, 514, and 524 are equalized, then note that $V_{602}=V_{612}=V_{622}$. As before, the display intensity (or illuminating energy) of any device is directly related to the magnitude of the grid-to-cathode potential. Since the grid (503, 513, 523)-to-cathode (504, 514, 524) potentials of devices 501, 511, and 521 are equivalent, then this, of course, results in the display luminescence energy levels in devices 501, 511, and 521 also being equivalent.

While various embodiments of an improved display bias arrangement, according to the present invention, have been described hereinabove, the scope of the invention is defined by the following claims.

What is claimed is:

1. In a display arrangement comprising a plurality of display digits, each display digit having a cathode, a grid and a terminal, the grid coupled to the terminal, and each display digit being arranged so that its display intensity is based on the magnitude of the grid voltage, the grid voltage being measured with respect to the cathode, a method of equalizing the display intensity amongst the plurality of display digits, the method comprising the following step:

(a) equalizing the magnitudes of the grid voltages amongst the display digits by connecting networks in series between the terminals and the grids, each network comprising a plurality of resistors, each resistor having a resistive value, the resistive values of the resistors being determined to equalize the voltage delivered to the respective grids.

2. The method of claim 1, each network comprising a first resistor and a second resistor, said first resistor being connected in series between said terminal and said grid, and said second resistor being connected from said grid to ground.

3. In a display arrangement comprising a plurality of display digits, each display digit having a cathode, a grid and a terminal, the grid coupled to the terminal, and each display digit being arranged so that its display intensity is based on the magnitude of the grid voltage, the grid voltage being measured with respect to the cathode, a method of equalizing the display intensity amongst the plurality of display digits, the method comprising the following step:

(a) equalizing the magnitudes of the grid voltages amongst the display digits by connecting networks in series between the terminals and the grids, each network comprising a plurality of diodes, each diode having a regulating voltage value, the regulating voltage values of the diodes being determined to equalize the voltage delivered to the respective grids.

4. The method of claim 3, each network comprising a first diode and a second diode, said first diode being connected in series between said terminal and said grid, and said second diode being connected from said grid to ground.

5. In a display arrangement comprising a plurality of display digits, each display digit having a cathode, a grid and a terminal, the grid coupled to the terminal, and each display digit being arranged so that its display intensity is based on the magnitude of the grid voltage, the grid voltage being measured with respect to the cathode, a method of equalizing the display intensity amongst the plurality of display digits, the method comprising the following step:

said equalizing step (a) being implemented by connecting networks in series between the terminals and the grids, each network comprising a diode having a regulating voltage value determined to equalize the voltage delivered to the respective grids.

6. The method of claim 5, said diode coupled between said terminal and said grid.

7. The method of claim 5, said diode coupled from said grid to ground.

* * * * *